United States Patent [19]

Harrison

[11] 4,315,338

[45] Feb. 16, 1982

[54] TOILET HINGE ARRANGEMENT

[75] Inventor: David E. Harrison, Columbus, Miss.

[73] Assignee: Beatrice Foods Co., Chicago, Ill.

[21] Appl. No.: 173,265

[22] Filed: Jul. 25, 1980

[51] Int. Cl.[3] ..... A47K 13/12

[52] U.S. Cl. ..... 4/236; 4/240

[58] Field of Search ..... 4/234, 236, 240

[56] References Cited

U.S. PATENT DOCUMENTS

| | | | |
|---|---|---|---|
| 491,019 | 1/1893 | Manson | 4/236 X |
| 558,931 | 4/1896 | Buick | 4/236 |
| 903,596 | 11/1908 | Martin et al. | 4/236 X |
| 976,395 | 11/1910 | Pryor | 4/236 |
| 1,194,392 | 8/1916 | Judd | 4/240 |
| 1,332,557 | 3/1920 | Judd | 4/240 |
| 2,255,913 | 9/1941 | Coggins | 4/236 |
| 3,551,922 | 1/1971 | Watson | 4/236 X |
| 3,590,401 | 7/1971 | Brown | 4/236 |
| 3,665,552 | 5/1972 | Toldo et al. | 4/236 |
| 4,087,884 | 5/1978 | Seiderman | 4/236 |

*Primary Examiner*—Henry K. Artis

*Attorney, Agent, or Firm*—Nathaniel A. Humphries

[57] ABSTRACT

A toilet has first and second hinges equidistantly spaced on opposite sides of a medial plane of the toilet with each hinge including a vertical hinge post having a horizontal pivot hole receiving a tubular pivot sleeve extending unitarily from a cover hinge body member with a pivot shaft of a seat hinge extending into the pivot sleeve for pivotal movement. The seat hinge and cover hinge each have outwardly extending spikes inserted in mounting bores in the seat and cover with the spikes having protrusions for retention in the mounting bores and being oriented at an acute angle to and flaring outwardly in reverse manner with respect to the medial plane with the post and hinge components being formed of fiberglass reinforced polypropylene.

21 Claims, 8 Drawing Figures

Fig-1
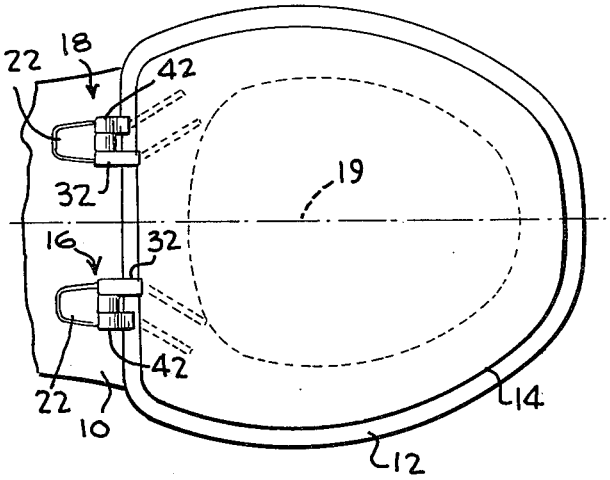
Fig-2
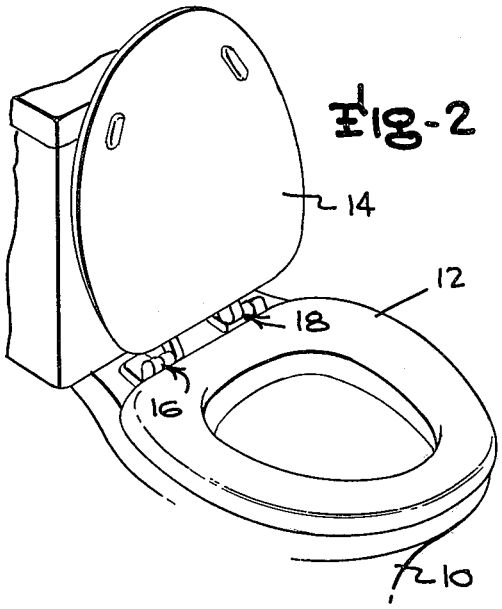
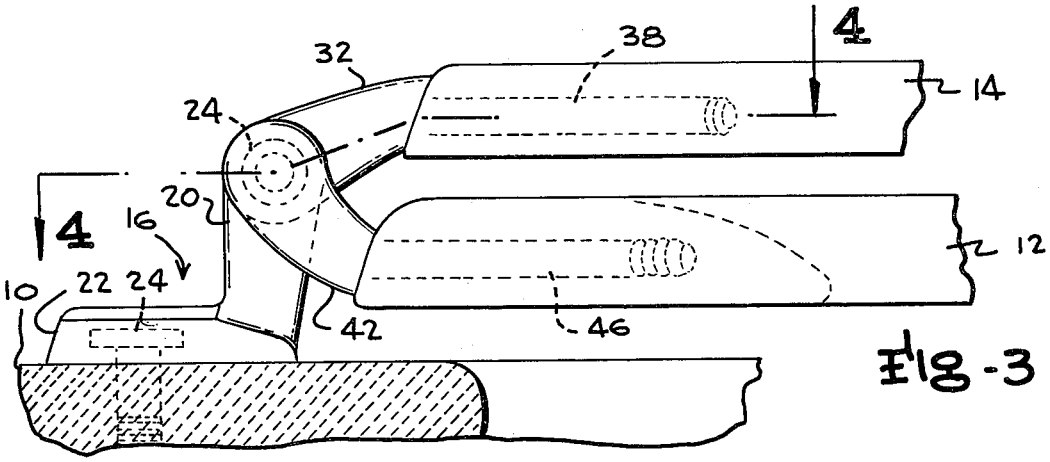
Fig-3
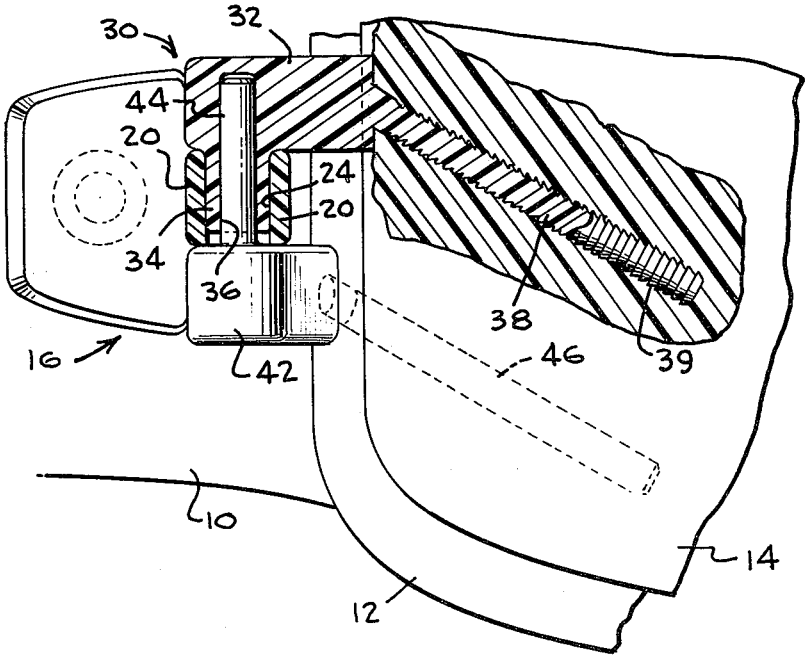
Fig-4

TOILET HINGE ARRANGEMENT

BACKGROUND OF THE INVENTION

This invention is in the field of toilets and is more specifically directed to a new and unique hinge combination for a toilet seat and toilet seat cover which avoids the use of conventional screw-type fasteners.

Toilet seat hinges have in the past usually been connected to toilet seat and/or covers by conventional screw-type fasteners in a well-known manner notwithstanding a number of disadvantages arising from the use of such fasteners. For example, screw fasteners frequently rust or corrode or become weakened and unsightly with the recesses in the hinge components and the screw fasteners acting to entrap and restrain unsanitary materials. Sealing covers for such screw fasteners have consequently been proposed in an effort to avoid the aforementioned problems of unsightly appearance and contamination; however, such sealing covers do not represent a complete solution to the aformentioned problems in that they frequently become dislodged and broken.

Another problem with the previously employed screw-type fasteners is that they are not always reliable and will frequently become loose and fall or pull out of the seat or cover into which they are inserted. Additionally, it sometimes occurs that the insertion of the screw-type fasteners damages or splits the seat or cover. Also, the use of metal screw-type fasteners frequently results in corrosion problems which are impossible to eliminate. Furthermore, the use of screw-type fasteners also entails a substantial amount of installation labor so as to increase the cost of the overall product.

Efforts to solve the foregoing problems have resulted in a variety of diccicult to assemble and complicated devices such as exemplified in U.S. Pat. Nos. 559,478; 976,395 and 1,077,779. However, the functional shortcomings and the expense of the prior known devices have precluded their widespread adoption and the most common method of mounting compression moulded and solid wood toilet seats to hinge assemblies remains the well-known screw-type fastener.

Therefore, it is the primary object of this invention to provide a new and improved means for attaching toilet seats and/or toilet seat covers to a toilet.

A further object of the invention is the provision of a new and improved combination of a toilet, hinge means and toilet seat and cover arrangement.

SUMMARY OF THE INVENTION

Achievement of the foregoing objects is enabled by the preferred embodiment of the invention through the provision of unique toilet seat and cover hinge means which provides a pivotal connection between a toilet and the seat and cover associated therewith. Each of the hinge means includes conventional downwardly extending threaded lug means positionable in a vertical opening in the toilet for attachment thereto by a threaded nut or the like.

Each of the hinge members is formed of fiberglass reinforced polypropylene and includes a vertical hinge post extending upwardly from a base member and having a transverse pivot hole in the form of a cylindrical surface having a horizontal axis positioned in the upper end portion of the hinge post. The pivot hole provides pivotal support for a cover hinge component consisting of a body member from which a tubular pivot sleeve extends transversely outwardly with the pivot sleeve being matingly received in the pivot hole for pivotal movement therein. The pivot sleeve includes an axially extending pivot opening extending completely along its length and into the body member portion of the cover hinge component with a cover mounting spike extending outwardly from the body member and having an axis and canted at an acute angle with respect to the pivot axis. The cover mounting spike is received in a mounting bore opening provided in the rear face of the cover member with the cover mounting spike including a plurality of outwardly extending protrusions which are oriented so that the spike can be inserted in the mounting bore but cannot be retracted therefrom.

A seat hinge component includes a swing arm from which a pivot shaft extends outwardly in a transverse manner to be received in the pivot opening extending axially along the length of the pivot sleeve of the cover hinge component. Thus, the pivot shaft is pivotally and coaxially mounted in the pivot sleeve of the cover hinge component. A seat mounting spike extends outwardly from the swing arm and includes outwardly extending protrusions which permit insertion of the seat mounting spike in a mounting bore provided in the rear face of the toilet seat.

An identical hinge member is provided on opposite sides of the toilet for engagement with opposite sides of the rear faces of the toilet seat and the toilet seat cover with the seat mounting spike and the cover mounting spike associated with each hinge member flaring outwardly as viewed from the rear of the toilet so as to provide for a geometric orientation tending to maintain the seat and the cover in position with practically no possibility of separation of the seat or seat cover from the hinge components.

In the preferred embodiment, the hinge components are formed of polypropylene reinforced with fiberglass fiber. In one alternative construction, the hinge components are formed of metal. Another embodiment does not employ the pivot sleeve and pivot shaft but instead uses an elongated pivot pin extending through the cover hinge component, the seat hinge component and the hinge post. In all embodiments, the seat mounting spike and the cover mounting spike are provided with outwardly extending protrusions which permit same to be inserted in the seat and seat cover but preclude withdrawal therefrom.

A better understanding of the preferred embodiment will be enabled when the following detailed description is considered in conjunction with the appended drawings in which like reference numerals are used for the same parts as illustrated in the figures thereof.

BRIEF DESCRIPTION OF THE DRAWINGS

FIG. 1 is a top plan view of the preferred embodiment of the inventive combination;

FIG. 2 is a perspective view illustrating the toilet seat cover and toilet seat component mounted on a toilet with the toilet seat cover being in an elevated or open position;

FIG. 3 is an enlarged side elevation partially in section of the embodiment illustrated in FIG. 1;

FIG. 4 is a sectional view taken along lines 4—4 of FIG. 3;

DESCRIPTION OF THE PREFERRED EMBODIMENTS

Figure 5:
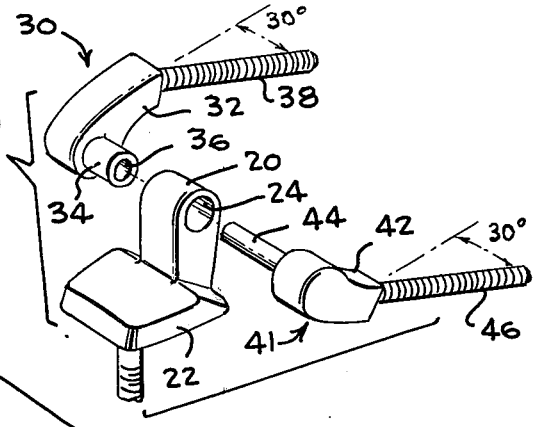
FIG. 5 is a rear exploded perspective view of the hinge component of the preferred embodiment.

Attention is initially invited to FIGS. 1 and 2 which illustrate the primary components of the preferred embodiment of the inventive combination which comprise a conventional toilet 10, a toilet seat 12, a toilet seat cover 14 and first and second hinge components 16 and 18. The first and second hinge components are formed of fiberglass reinforced polypropylene of identical construction with the exception of the fact that they are oriented in mirror-like manner with respect to each other on opposite sides of a medial plane 19 of the toilet. Each of the hinge components includes a vertically extending hinge post 20 extending upwardly from a base member 22 which is attached to the toilet 10 by conventional bolt or stud means 23 in a well-known manner. The upper end of hinge post 20 includes a pivot hole 24 in the form of a cylindrical surface having a horizontal axis defining a pivot axis for the toilet seat 12 and the toilet seat cover 14.

A cover hinge component 30 is mounted for pivotal movement in the pivot hole 24 and includes a body member 32 from which a transversely extending pivot sleeve 34 extends transversely outwardly as best shown in FIGS. 4 and 5. Pivot opening 36 is coaxial with the pivot hole 24 and extends inwardly into the body member 32 as best shown in FIG. 4. Thus, it will be seen that the outer surface of the pivot sleeve 34 is matingly engaged with the pivot hole 24 so that the body member 32 etc. is capable of pivotal rotation about the axis of the pivot hole.

Figure 6:
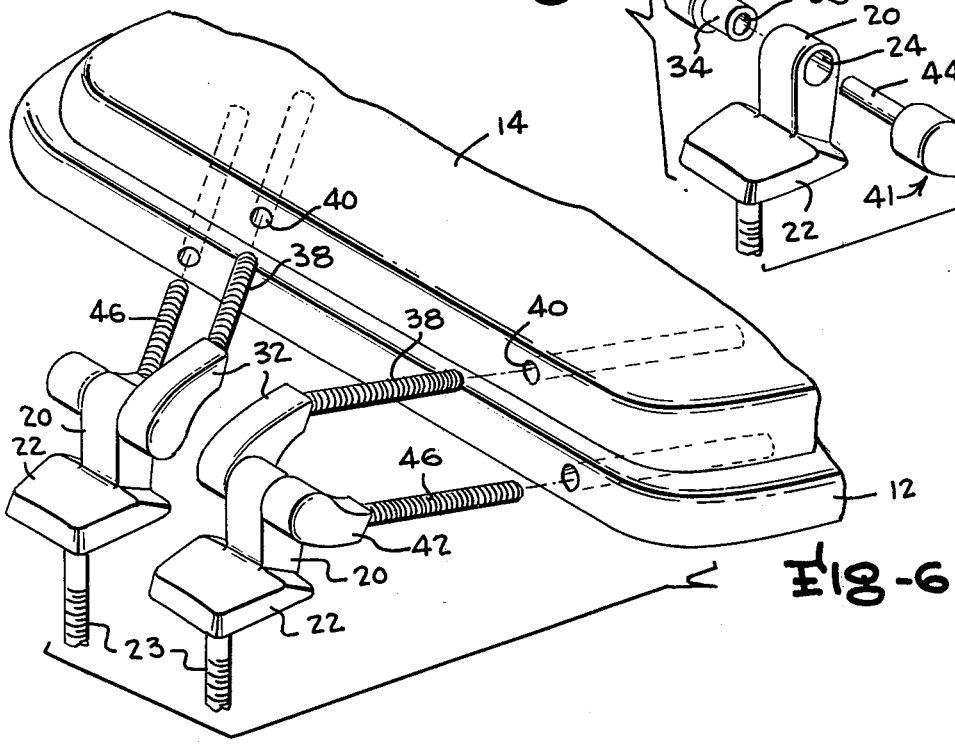
FIG. 6 is a rear exploded perspective view of two of the hinge components as associated with a toilet seat and toilet seat cover.

A cover-mounting spike 38 extends outwardly from the body member 32 and includes outwardly extending protrusions 39 shaped to permit the cover mounting spike 38 to be inserted in a mounting bore 40 provided in the toilet seat cover 14 as best shown in FIG. 6. The protrusions on the cover mounting spike 38 preclude removal of the spike from the bore 40 after it has been forcefully inserted therein.

A seat hinge component 41 is mounted on the hinge post 20 on the opposite side from the cover hinge component 30 and includes a swing arm 42 from which a pivot rod or shaft 44 unitarily extends outwardly in a transverse manner. Pivot shaft 44 is matingly received in the pivot opening 36 of pivot sleeve 34 and extends inwardly to have an end termination in the body member 32 as clearly shown in FIG. 4. A seat-mounting spike 46 of identical construction to the cover mounting spike 38 extends unitarily outwardly from the swing arm 42 and is forcefully inserted in a mounting bore 47 on the rear face of the toilet seat 12. It should be observed that the cover mounting spike 38 and the seat mounting spike 46 are parallel to each other and both are oriented at approximately 30° from the medial plane 19 of the toilet and are consequently oriented at an acute angle with respect to the pivot axis which extends coextensively with respect to the cylindrical pivot hole 24.

One extremely significant aspect of the invention resides in the fact that the cover mounting spike 38 and seat mounting spike 46 of the two different hinge components 16 and 18 are oriented in opposite manner with respect to the toilet seat 12 and toilet seat cover 14 so that their outer ends are spaced outwardly from the medial plane 19 a greater distance than are their inner ends. This orientation precludes removal of the spike members from within their mounting bores when the assembly is connected to the toilet 10 as shown.

Figure 7:
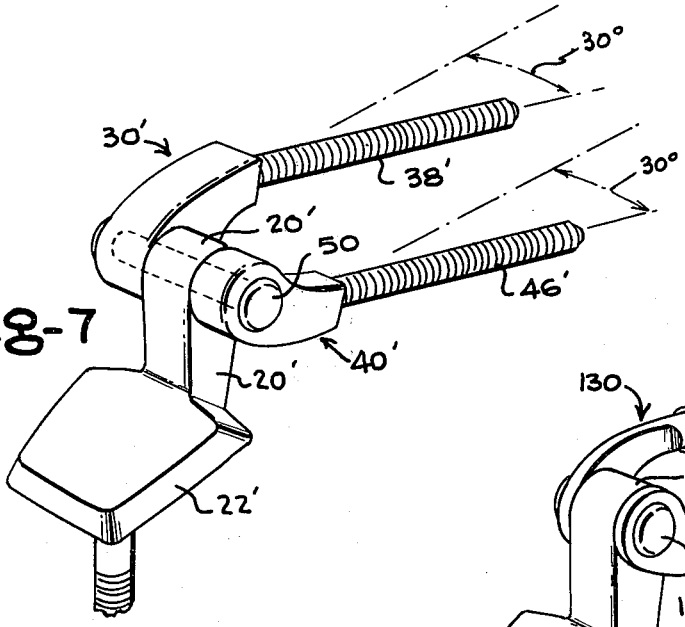
FIG. 7 is a rear elevation view of alternative hinge components in assembled condition.

FIG. 7 illustrates a second embodiment of the invention which differs from the first embodiment in that a cover hinge component 30' and a seat hinge component 40' mounted on a base 22' are directly mounted for pivotal movement on a pivot pin 50 extending through a bore in the hinge components and a pivot opening in a hinge post 20'. A cover mounting spike 38' and a seat mounting spike 46' extend outwardly from their hinge components and are identical to the elements 38 and 46 of the first embodiment. It will be observed that the spikes 38' and 46' are both parallel to each other and are oriented at an angle of approximately 30° from the median plane as shown in FIG. 7 so that they are consequently oriented at an acute angle of approximately 60° with respect to the pivot axis of pivot pin 50. The components of the embodiment of FIG. 7 are preferably formed of fiberglass reinforced polypropylene. However, other components, such as nylon, metal or the like, could also be used.

Figure 8:
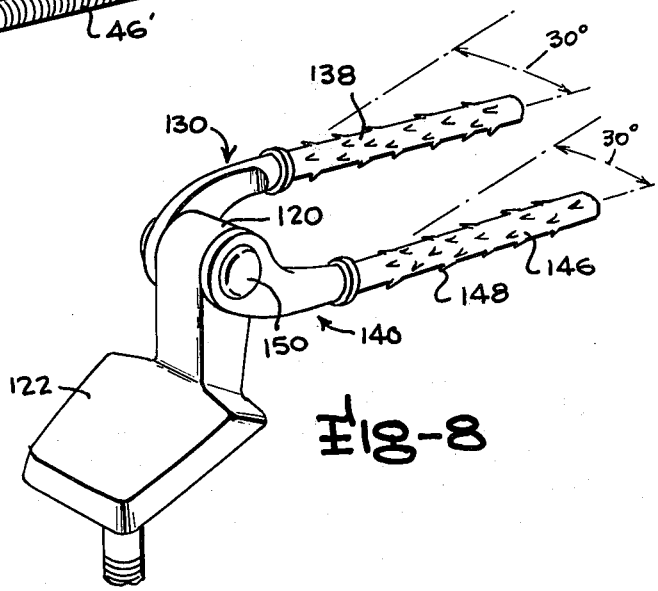
FIG. 8 is a rear perspective view of a second alternative hinge component.

FIG. 8 illustrates a third embodiment of the invention comprising a base 122 and hinge post 120, cover hinge component 130 and a seat hinge component 140 formed of metal and from which respectively extend a cover mounting spike 138 and a seat mounting spike 146 formed of metal and including a plurality of barbed protrusions 148 which permit the spikes to be inserted in mounting bores in the cover and the seat of the toilet for retention in a manner analagous to the operation of the spikes of the first and second embodiments. It should be observed that the hinge components 130 and 140 and their associated spikes are formed of metal and are mounted on a pivot pin 150 extending through a pivot hole in a hinge post 120 basically identical to hinge post 20' of the second embodiment. The spikes 138 and 146 are oriented at approximately 30° with respect to the medial plane of the toilet.

It should be understood that the mirror-like reverse orientation of the cover mounting spike and seat mounting spike of the hinges of each embodiment precludes removal of the toilet seat or the seat cover after the hinges are mounted on the toilet. Additionally, all embodiments provide for a complete elimination of the screw-type mountings previously employed and result in a smooth easy-to-clean surface requiring a minimum of maintenance.

Fabrication of the device is easily achieved by first inserting the spikes in their respective mounting bores in the toilet seat cover and toilet seat following which the hinges are positioned with bolts 23 in the mounting openings in the toilet with a mounting nut being attached to the stud of each of the hinge members.

Numerous modifications of the disclosed embodiments will undoubtedly occur to those of skill in the art and it should be understood that the spirit and scope of the invention is to be limited solely by the appended claims.

I claim:

1. A toilet hinge comprising a hinge post fixedly connectable to a toilet to extend upwardly therefrom, a pivot hole defined by an axially horizontal cylindrical surface extending transversely through an upper portion of said hinge post to define a pivot axis, a cover hinge component including a body member with a pivot sleeve extending transversely outwardly from said body member and having an outer end matingly received in said pivot hole with a pivot opening extending axially inward from the outer end of said pivot sleeve and a cover mounting spike extending downwardly from said body member at an acute angle with respect to said pivot axis and further including a seat hinge component including a swing arm, a pivot shaft extending transversely outwardly of said swing arm and matingly received in said pivot opening of said pivot sleeve and a seat mounting spike extending outwardly from said swing arm at an acute angle with respect to said pivot axis.

2. The toilet hinge of claim 1 wherein said seat mounting spike and said cover mounting spike are oriented at a common angle with respect to said pivot axis.

3. The toilet hinge of claim 1 wherein said pivot opening extends axially through the entire length of said pivot sleeve and has an inner end termination in said body member.

4. A toilet hinge of claim 1 wherein said seat mounting spike and said cover mounting spike each include surface protrusions permitting mating insertion of said spikes in openings in a toilet seat and a toilet cover respectively but precluding removal therefrom.

5. The toilet hinge of claim 1 wherein said hinge post, said cover hinge component and said seat hinge component are formed of fiberglass reinforced polypropylene.

6. The toilet hinge of claim 5 wherein said cover mounting spike and seat mounting spike are oriented at a common angle with respect to said pivot axis.

7. The toilet hinge of claim 1 wherein said seat mounting spike and said cover mounting spike are oriented at a common angle with respect to said pivot axis and said pivot opening extends axially through the entire length of said pivot sleeve and has an inner end termination in said body member and said pivot shaft has an outer end termination positioned in said body member.

8. The toilet hinge of claim 7 wherein said seat mounting spike and said cover mounting spike each include surface protrusions permitting mating insertion of said spikes in openings in a toilet seat and a toilet cover respectively but precluding removal therefrom.

9. The toilet hinge of claim 8 wherein said hinge post, said cover hinge component and said seat hinge component are formed of fiberglass reinforced polypropylene.

10. The toilet hinge of claim 1 wherein said seat mounting spike and said cover mounting spike are oriented at a common angle with respect to said pivot axis and said seat hinge component and said cover hinge component are respectively positioned on opposite sides of said hinge post.

11. The toilet hinge of claim 10 wherein said pivot opening extends axially through the entire length of said pivot sleeve and has an inner end termination in said body member.

12. The toilet hinge of claim 10 wherein said seat mounting spike and said cover mounting spike each include surface protrusions permitting mating insertion of said spikes in openings in a toilet seat and a toilet cover respectively by precluding removal therefrom.

13. The toilet hinge of claim 10 wherein said hinge post, said cover hinge compartment and said seat hinge component are formed of fiberglass reinforced polypropylene.

14. The combination of a toilet having a medial plane, a toilet seat, a toilet seat cover, first and second hinges each comprising a hinge post fixedly connected to said toilet to extend upwardly therefrom, a pivot hole defined by an axially horizontal cylindrical surface extending transversely through an upper portion of said hinge post to define a pivot axis, a cover hinge component including a body member with a pivot sleeve extending transversely outwardly from said body member and having an outer end matingly received in said pivot hole with a pivot opening extending axially inwardly from the outer end of said pivot sleeve and a cover mounting spike extending outwardly from said body member at an acute angle with respect to said pivot axis and having an outer end embedded in a mounting bore in the toilet seat cover and further including a seat hinge component including a swing arm, a pivot shaft extending transversely outwardly of said swing arm and matingly received in said pivot opening of said pivot sleeve and a seat mounting spike extending outwardly from said swing arm at an acute angle with respect to said pivot axis and having an outer end embedded in a mounting bore in the toilet seat wherein said first and second hinges are equidistantly spaced from each other on opposite sides of said medial plane and said seat mounting spike and cover mounting spike of the hinges flare outwardly with respect to the medial plane so that their outer ends are spaced a greater distance from said medial plane than is their innermost portions.

15. The invention of claim 14 wherein said seat mounting spike and said cover mounting spike are oriented at a common angle with respect to said pivot axis.

16. The invention of claim 14 wherein said pivot opening extends axially through the entire length of said pivot sleeve and has an inner end termination in said body member.

17. The invention of claim 14 wherein said seat mounting spike and said cover mounting spike each include surface protrusions permitting mating insertion of said spike in said mounting openings in the toilet seat and toilet seat cover respectively but precluding removal therefrom.

18. The invention of claim 17 wherein said hinge post, said cover hinge component and said seat hinge component are formed of fiberglass reinforced polypropylene.

19. The invention of claim 14 wherein said cover hinge component and said seat hinge component of each hinge are respectively positioned on opposite sides of said hinge post.

20. A hinge component comprising a hinge post fixedly connectable to a toilet to extend upwardly therefrom, a pivot hole defined by an axially horizontal cylindrical surface extending transversely through an upper portion of said hinge post to define a pivot axis, a first hinge component including a body member with a pivot sleeve extending transversely outwardly from said body member and having an outer end matingly received in said pivot hole with a pivot opening extending axially inwardly from the outer end of said pivot sleeve, a second hinge component including a swing arm, a pivot shaft extending transversely outwardly of said swing arm and matingly received in said pivot opening of said pivot sleeve and attachment means on said first and second hinge components for permitting attachment thereof to first and second pivotal members.

21. The invention of claim 20 wherein said first and second hinge components are on opposite sides of said hinge post.

* * * * *